US011502430B2

(12) United States Patent
Berg et al.

(10) Patent No.: US 11,502,430 B2
(45) Date of Patent: Nov. 15, 2022

(54) LOCKABLE CONNECTION MODULE

(71) Applicant: Phoenix Contact GmbH & Co. KG, Blomberg (DE)

(72) Inventors: Peter Berg, Schlangen (DE); Andreas Metzger, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 279 days.

(21) Appl. No.: 17/029,120

(22) Filed: Sep. 23, 2020

(65) Prior Publication Data

US 2021/0098907 A1 Apr. 1, 2021

(30) Foreign Application Priority Data

Sep. 27, 2019 (LU) ..... 101419

(51) Int. Cl.
*H01R 9/26* (2006.01)
*H01R 25/14* (2006.01)

(52) U.S. Cl.
CPC ..... *H01R 9/2675* (2013.01); *H01R 9/2608* (2013.01); *H01R 25/14* (2013.01)

(58) Field of Classification Search
CPC ..... H01R 4/48; H01R 4/4836; H01R 4/4854; H01R 9/223; H01R 9/26; H01R 9/2416; H01R 9/2675; H01R 9/2608; H01R 11/20; H01R 25/14; H01H 27/10
USPC ..... 200/42.01; 337/186, 187, 189, 190; 361/626, 630, 633, 636, 642, 643; 439/441, 709, 715, 729, 835
See application file for complete search history.

(56) References Cited

U.S. PATENT DOCUMENTS 5,700,159 A 12/1997 Albeck
7,410,385 B2 * 8/2008 Buttner ..... H01R 9/2608 439/441
7,561,018 B2 * 7/2009 Buettner ..... H01H 31/122 337/186
2003/0129871 A1 7/2003 Follingstad
2006/0243569 A1 * 11/2006 Buettner ..... H02B 1/0565 200/42.01

(Continued)

FOREIGN PATENT DOCUMENTS

CN 1138223 A 12/1996
CN 1725569 A 1/2006

(Continued)

*Primary Examiner* — William H. Mayo, III
(74) *Attorney, Agent, or Firm* — Leydig, Voit & Mayer, Ltd.

(57) ABSTRACT

A connection module for mounting on a busbar module or several busbar modules extending in a longitudinal direction includes: a housing, a rear side of which is mounted or mountable on the busbar module or busbar modules; a crossbar, movable on a first longitudinal side of the rear side of the housing transversely to the longitudinal direction, so as to provide a positive-locking connection of the connection module to the busbar module or the busbar modules in a mounted position of the connection module; and a latching profile on a second longitudinal side, opposite the first longitudinal side, of the rear side of the housing, the latching profile providing a positive-locking connection of the connection module to the busbar module or the busbar modules in the mounted position.

19 Claims, 5 Drawing Sheets

(56) References Cited

U.S. PATENT DOCUMENTS

| | | | | |
|---|---|---|---|---|
| 2007/0212904 | A1* | 9/2007 | Buttner | H01R 4/4809 439/76.2 |
| 2010/0128417 | A1 | 5/2010 | Ichinomiya et al. | |
| 2011/0100705 | A1 | 5/2011 | Matsui | |
| 2013/0157520 | A1 | 6/2013 | Koellmann et al. | |
| 2014/0199864 | A1 | 7/2014 | Dangat et al. | |
| 2015/0162671 | A1* | 6/2015 | Hoppmann | H01R 4/4836 439/370 |
| 2018/0006385 | A1* | 1/2018 | Wilinski | H01R 9/223 |

FOREIGN PATENT DOCUMENTS

| | | | |
|---|---|---|---|
| CN | 1933256 | A | 3/2007 |
| CN | 101010835 | A | 8/2007 |
| CN | 101533978 | A | 9/2009 |
| CN | 101752147 | A | 6/2010 |
| CN | 102055152 | A | 5/2011 |
| CN | 102956409 | A | 3/2013 |
| CN | 106030915 | A | 10/2016 |
| CN | 107912073 | A | 4/2018 |
| DE | 102006031129 | A1 | 1/2007 |
| DE | 10351479 | B4 | 5/2012 |
| DE | 202017104591 | U1 | 11/2018 |
| DE | 102018005682 | A1 | 2/2019 |
| EP | 1460720 | A1 | 9/2004 |
| EP | 2605335 | A2 | 12/2012 |
| FR | 2177207 | A5 | 11/1973 |
| WO | WO 2017153507 | A1 | 9/2017 |

* cited by examiner

LOCKABLE CONNECTION MODULE

CROSS-REFERENCE TO PRIOR APPLICATION

Priority is claimed to Luxembourgian Patent Application No. LU 101419, filed on Sep. 27, 2019, the entire disclosure of which is hereby incorporated by reference herein.

FIELD

The invention relates to a connection module for attachment to a busbar module.

BACKGROUND

In order to simplify the wiring expenditure for distributing a direct current along a support rail, the direct current can be forwarded from a connection module to an adjacent connection module on the support rail. The document EP 2 086 1 0 1 A2 describes for this purpose connection sliders, in order to electrically connect adjacent connection modules on a support rail with regard to a potential. However, such connection sliders expand the installation height of the connection modules, and can forward only a single potential, and the number of contact points increases with the length of the distributor system, which is why it is unsuitable for high direct currents, e.g., for distributing a direct current on the order of 40 A.

In order to reduce the wiring expenditure and to distribute such a direct current, busbars that extend continuously along several connection modules can be used. The corresponding connection modules are then plugged onto this distributor rail system. Since the mechanical connection of the connection modules to the busbar modules secures the electrical contact, it must be reliable and releasable.

SUMMARY

In an embodiment, the present invention provides a connection module for mounting on a busbar module or several busbar modules extending in a longitudinal direction, comprising: a housing, a rear side of which is mounted or mountable on the busbar module or busbar modules; a crossbar, movable on a first longitudinal side of the rear side of the housing transversely to the longitudinal direction, so as to provide a positive-locking connection of the connection module to the busbar module or the busbar modules in a mounted position of the connection module; and a latching profile on a second longitudinal side, opposite the first longitudinal side, of the rear side of the housing, the latching profile being configured to provide a positive-locking connection of the connection module to the busbar module or the busbar modules in the mounted position.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
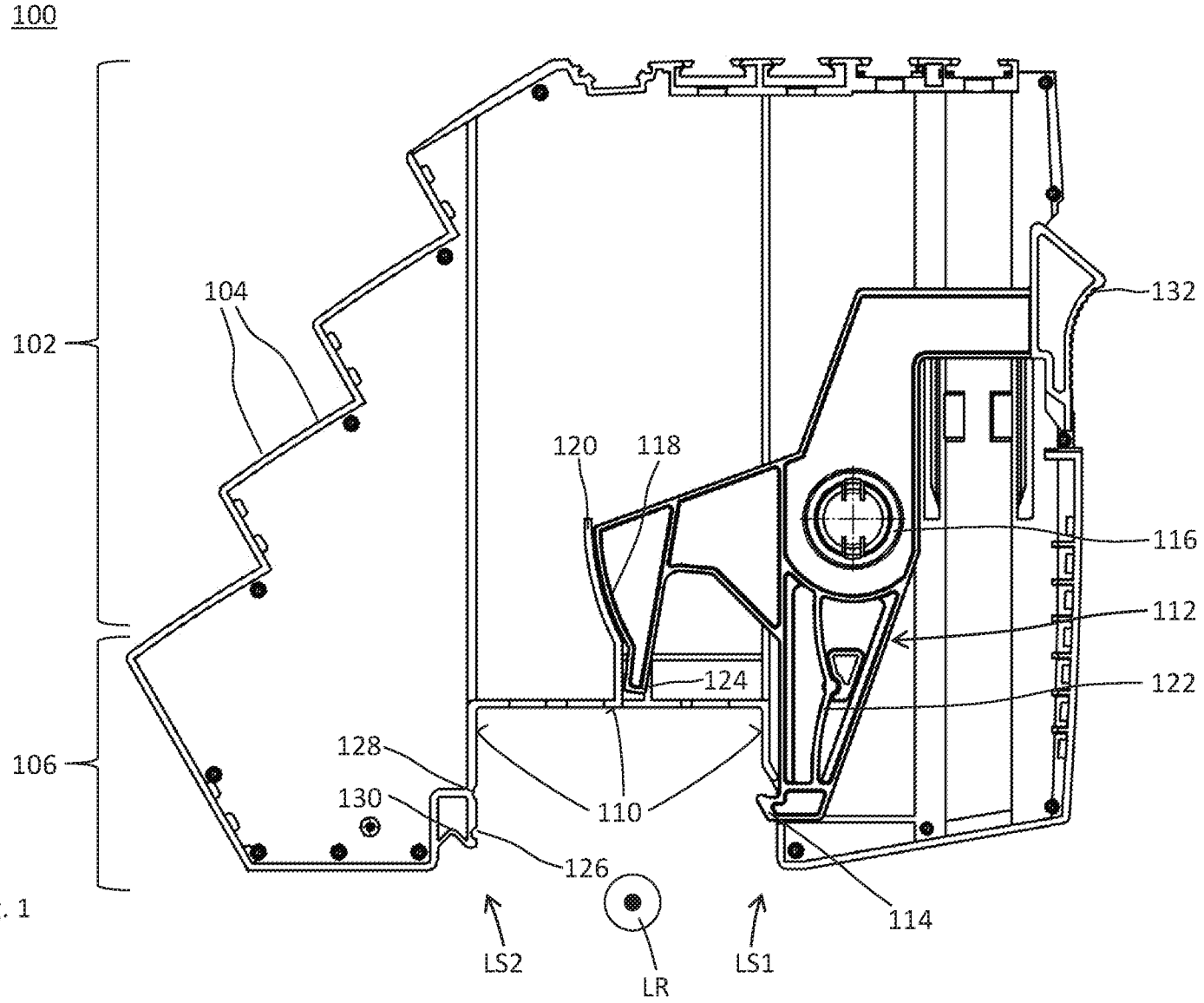
FIG. 1 shows a schematic sectional view of a connection module according to an exemplary embodiment of the invention.

In an embodiment, the present invention provides a technique for a reliable, releasable attachment of a connection module to a busbar module.

Further features and advantages of exemplary embodiments of the invention are described below with partial reference to the drawings.

One aspect of the invention relates to a connection module for mounting on a busbar module or several busbar modules extending in a longitudinal direction. The connection module comprises a housing, the rear side of which is mounted or mountable on the busbar module or modules. The connection module further comprises a crossbar, movable transversely to the longitudinal direction on a first longitudinal side of the rear side, for effecting the positive-locking connection of the connection module to the busbar module or modules in a mounted position of the connection module. The connection module further comprises a latching profile on a second longitudinal side, opposite the first longitudinal side, of the rear side, for effecting the positive-locking connection of the connection module to the busbar module or modules in the mounted position.

In exemplary embodiments, because of a pluggable contact (that is, a pluggable contact between rail contacts of the connection module and respective busbars of the busbar module or modules), it can be important to ensure a sufficient mechanical hold, e.g., against environmental influences, between the connection module and the busbar module or modules. This hold can be achieved by means of the positive-locking connection by means of the crossbar and/or the latching profile.

In exemplary embodiments, the connection module (for example, an electrical device circuit breaker) can be pluggable (for example, starting from the unlocked position) on the busbar module or modules (for example, a distributor rail system), can be removable (for example, by pressing the operating surface starting from the mounted position), and/or can have sufficient hold against environmental influences in the mounted position.

In a distributor rail system (also, for short: system) having several connection modules, e.g., on the busbar module or several busbar modules connected to one another, exemplary embodiments enable the individual connection modules (for example, device circuit breakers) to be changed from the system—for example, from an assembly having several adjoining connection modules.

An operating surface of the pivot lever can be arranged on the front side of the connection module or can be accessible from the front side of the connection module. Exemplary embodiments can enable a single connection module (for example, a device circuit breaker) to be conveniently removable from the assembly. By allowing the attachment and/or removal of individual connection modules within an assembly of adjoining connection modules (preferably also at an extension of the busbar module to a distributor system), a direct current can be distributed, without creating a gap or empty space (for example, due to the extension of the distributor system).

The rear side can comprise a mounting recess for receiving the busbar module in the mounted position. The first longitudinal side and the second longitudinal side of the rear side can comprise surfaces turned towards one another—for example, surfaces of the mounting recess turned towards one another. The surface of the first longitudinal side can have an opening. In the mounted position, the crossbar can project from the opening. Alternatively or additionally, the surface of the second longitudinal side can have the latching profile.

The connection module can further comprise a pivot lever mounted in the housing in a pivotably-movable manner. The pivot lever can be pivotably movable between the mounted position and an unlocked position. Upon the pivoting movement from the unlocked position into the mounted position, the pivot lever can move the crossbar out of the housing of the connection module in order to form a positive-locking connection with the busbar module.

The connection module, e.g., the pivot lever, can further comprise a punch. The punch can be designed, upon the mounting of the connection module, to move the pivot lever from the unlocked position into the mounted position.

Upon the pivoting movement from the mounted position into the unlocked position, the pivot lever can press a punch of the connection module—preferably, of the pivot lever (for example, the aforementioned punch)—against a contact surface of the busbar module. For example, the pressure of the punch can release a contact between rail contacts of the connection module and the respective busbars of the busbar module or modules.

The pivot lever can be pivotably movable into the unlocked position by means of an operating surface projecting from the housing at a front side in the mounted position. For example, the actuation of the operating surface can pivot the pivot lever into the unlocked position and thus bring about the pressure of the punch on the contact surface of the busbar module in order to release the contact.

The pivot lever can be pivotably movable from the unlocked position into the mounted position by means of a spring-elastic element.

The spring-elastic element can be connected to the pivot lever. The spring-elastic element can comprise a section that is movable relative to the pivot lever. Upon the pivoting movement between the unlocked position and the mounted position, the movable section can bear against an obstacle (125) arranged in the housing.

The obstacle can serve as a fixed bearing, relative to the connection module, of the movable section. Upon the pivoting movement, a movement of the movable section relative to the pivot lever can result from the fixing of the movable section relative to the connection module, which movement causes the spring force for resetting the pivot lever into the mounted position.

The pivot lever can be mounted in a monostable manner with respect to the unlocked position and the mounted position—for example, with the mounted position as the rest position.

Alternatively or additionally, the pivot lever can be mounted in a bistable manner with respect to the unlocked position and the mounted position. The bistable mounting can comprise a spring-elastic element (for example, the aforementioned spring-elastic element) having a sliding section. Upon the pivoting movement between the unlocked position and the mounted position, the sliding section can slide over an obstacle (for example, the aforementioned obstacle) arranged in the housing.

The spring-elastic element can comprise, for example, one, two, or more curved spokes. The spokes can be curved in a plane of the pivoting movement. The spokes can extend (at least substantially) radially from a pivot bearing of the pivot lever. The spokes can extend (at least substantially) radially with respect to the pivot bearing of the pivot lever. The spokes can be connected to one another at the movable section or the sliding section.

The pivot lever, the spring-elastic element (including, for example, the spokes, the movable section, and/or the sliding section), the punch, and/or the operating surface can be integrally formed in one piece—for example, by means of injection molding.

The connection module can also be designed to branch off a direct current distributed along the busbar module or modules. Optionally, the connection module can comprise at least two connection contacts for connecting a consumer or a source of the direct current. The connection contacts can be arranged on a front side of the connection module.

Alternatively or additionally, the connection module can comprise at least two rail contacts projecting on the rear side. For branching off the direct current, the rail contacts can be designed to contact (for example, clamp) one busbar of the busbar module in each case, if the connection module is in the position mounted on the busbar module. For example, at least one or each of the rail contacts comprises a double-sided spring contact, which is designed to contact the respective busbar on both sides in a spring-elastic manner.

In the housing, the rail contacts on the rear side and the connection contacts on the front side can be electrically connected to one another in pairs. An overcurrent circuit breaker for protecting the consumer or the source of the direct current can be connected between the rail contacts on the rear side and the connection contacts on the front side.

The rear side of the connection module can be mounted or mountable on at least one busbar module. In the mounted position, the crossbar (for the positive-locking connection of the connection module to the busbar module) can bear against an indent of the busbar module. Alternatively or additionally, in the mounted position, the latching profile (for the positive-locking connection of the connection module to the busbar module) can be in engagement with a complementary latching profile of the busbar module. Thereby, the rail contacts of the connection module can contact the busbar module if the connection module is in the mounted position.

Furthermore, the rear side can be mounted or mountable on first and second busbar modules adjoining one another in the longitudinal direction at their respective front sides. The crossbar for the positive-locking connection of the connection module to the first and second busbar modules in the mounted position can bear against both an indent of the first busbar module and an indent of the second busbar module. Alternatively or additionally, the latching profile for the positive-locking connection of the connection module to the first and the second busbar modules can be engaged in the mounted position both with a complementary latching profile of the first busbar module and with a complementary latching profile of the second busbar module. Thereby, at least a first of the rail contacts of the connection module can contact the first busbar module, and at least a second of the rail contacts of the connection module can contact a second busbar module of the adjacent busbar modules, if the connection module is in the mounted position. In other words, the connection module can be mounted or mountable above a front-side connection point (also: extension) of two adjoining busbar modules (preferably without a loss of plug-in space or empty space at the connection point).

The connection module can comprise an overcurrent circuit breaker between the rail contacts and the connection contacts for protecting the consumer or the source of the direct current. The overcurrent circuit breaker (also: fuse—preferably: device fuse) can be an electronic fuse.

The busbar module can be attached to a support rail. The connection module can be connected to a data bus along the support rail—preferably via data bus contacts acting, in the mounted position, on the housings of the connection modules. The connection module can output a state of the electronic fuse via the data bus. Alternatively or additionally, the connection module can receive an instruction for resetting (that is, setting back or closing) the electronic fuse via the data bus.

With exemplary embodiments of the busbar module, by arranging the busbars between a rear section and a front section, transverse bars at the front section can prevent the inadvertent contact or short-circuiting of the busbars. In the same or additional exemplary embodiments of the busbar module, since the transverse bars extend transversely to the longitudinal direction, the busbars can each be contacted by a spring-elastic rail contact of the connection module in the transverse direction (that is, along a gap between the transverse bars). As a result, the connection modules can be built in narrow form in the longitudinal direction, or more connection modules can be mounted on a given length of the support rail.

Exemplary embodiments of the busbar module can enable the distribution (for example, the line and/or branch) of the direct current parallel to the support rail. The installation space can be utilized in an optimized manner, e.g., without increasing a structural height of the connection modules, in that the busbars are arranged in a U-shaped recess of the support rail by means of the busbar module.

The busbar modules can reduce the wiring expenditure for distributing the direct current to the connection modules (for example, from the connection modules, for the connection modules, or via the connection modules) on the support rail. The direct current can be an operating current for operating the respective connection module or a consumer powered by means of the connection module.

An upper edge of the busbar can be within the housing of the busbar module. The upper edge of the busbar can be arranged lower (that is, further to the rear section or the support rail) than the transverse bars. As a result, an inadvertent short circuit can be prevented—preferably without insulating the upper edge—whereby production can be simplified, and/or the rail contacts do not have to overlap an insulation at the upper edge.

The nominal voltage of the direct current can be 12 V to 24 V or 24 V to 48 V.

The housing of the busbar module—preferably the rear section—can have indents on a first longitudinal side for mounting the connection module. Alternatively or additionally, the housing of the busbar module—preferably the rear section—can, on a second longitudinal side, have latching profiles for mounting the connection module.

In the mounted position of the connection module, the crossbar can, for effecting the positive-locking connection, be designed to interact with an indent or several indents of the respective busbar module. In a mounted position, the crossbar can bear against the respective indent and/or, in the unlocked position, release the indent. Alternatively or additionally, each of the latching profiles can be designed, in the mounted position of the connection module, to engage in a positive-locking manner with a complementary latching profile of the respective busbar module.

In the housing of the busbar module, an electrically-insulating partition wall can be arranged (for example, in each case) between two adjacent busbars of the at least two busbars.

The support rail comprises latching bars projecting transversely to the longitudinal direction. The support rail can be a U-shaped hat rail, e.g., in accordance the DIN EN 50 022 standard. The hat rail can have side legs with latching bars that are splayed outwards.

The rear section of the or each busbar module can have at least two, opposite latching lugs turned towards one another. The latching lugs can be designed to slide from a released position of the busbar module via the latching bars of the support rail into a latching position of the busbar module, in which the latching lugs connect the rear section of the busbar module to the support rail in a positive-locking manner.

The busbars in the busbar module can comprise a busbar for functional grounding, a busbar to a neutral conductor, and a busbar to a positive pole. The busbars can form a powerbus.

Furthermore, the busbar module can, on at least a front side of the busbar module, comprise in each case a punch contact that is or can be plugged onto an associated busbar in the longitudinal direction. The punch contacts can be designed to electrically connect the busbars of the busbar module to corresponding busbars of a busbar module adjoining the respective front side.

The punch contacts can enable a modular expandability of the busbar module along the support rail. The punch contacts can be mirror-symmetrical in the longitudinal direction with respect to the front side. At least one or each of the punch contacts can comprise two, three, or more laminated metal sheets of the same shape, stacked one on top of the other.

In exemplary embodiments, the punch contacts can in each case electrically connect the individual busbars of the directly-adjoining (for example, attached to one another on the front side) busbar modules—preferably without a loss of plug-in space arising. Alternatively or additionally, the punch contacts can permit the construction of a distributor system (also: distributor rail system) having a plurality of busbar modules. The distributor system can thus be modularly expandable—for example, by the separate electrical connection of the associated busbars. For example, the punch contacts can comprise a busbar connector, optimized for installation space, for a 24-V direct current distributor system.

At least one or each of the punch contacts is preferably designed to carry an electrical connection of the associated busbars for 40-A continuous current.

The punch contact can extend in the longitudinal direction or in planes (that is, in a straight line) of the two, electrically-connected busbars. The punch contact can be perpendicular to the height dimension of the associated busbar.

To protect against overload and/or short-circuit—preferably from electrical 24-V DC loads—the connection module can comprise a (for example, electronic) device circuit breaker. The device circuit breaker can be designed to limit a load current (that is, the current branched off at the busbars and/or the current output at the connection contacts) to a specific value (for example, 40 A).

The connection contacts of a connection module can comprise an output channel (for example, with two or three connection contacts) or several output channels. The load current can be individually protected for each output channel. For example, a current intensity of up to 40 A can be assigned to a connection module or an output channel.

Exemplary embodiments can enable a connection module indirectly mounted on the support rail via the busbar module to tap the direct current distributed along the support rail. The busbar module according to the first aspect can be designed for attachment to the support rail. The attachment module according to the second aspect can be designed for attachment to the rail module.

The connection module can be connected or connectable indirectly (preferably, exclusively indirectly and/or exclusively by means of the busbar module) to the support rail. The connection module can be connected or connectable only to the busbar module, which in turn is or can be connected to the support rail.

Exemplary embodiments can be installed or installable on a universal or existing support rail, such as on a support rail that is not limited to a direct current system or a system for the distribution of direct current. By means of the busbar modules specific to and/or designed for the direct current, an existing support rail can be further developed for distributing the direct current. Alternatively or additionally, the indirect mounting of the connection modules on the support rail or the positive-locking connection of the connection modules to the busbar module can ensure that the connection module and the busbar module are designed for the same or a matched current (for example, the same or matched current type, current strength, and/or voltage).

At least one or each of the rail contacts can comprise a double-sided contact, e.g., a double-sided spring contact (preferably, a tulip contact). The spring contact can be designed to contact the respective busbar on both sides in a spring-elastic manner. At least one or each of the rail contacts can be designed to contact the busbar from both sides in a spring-elastic manner in a gap between the transverse bars. The rail contact can be a double-sided double contact or a double-sided multiple contact with two or more contacts on each side of the busbar.

FIG. 1 shows a schematic sectional view of a connection module for mounting on a busbar module or on several busbar modules extending in a longitudinal direction. Here, the connection module is in general indicated with reference sign 100. The longitudinal direction, LR, is perpendicular to the image plane of FIG. 1.

The connection module 100 comprises a housing, the rear side 106 of which is mounted or mountable on the busbar module or modules. Furthermore, the connection module 100 comprises a crossbar 114, movable on a first longitudinal side LS1 of the rear side 106 transversely to the longitudinal direction LR, for effecting the positive-locking connection of the connection module 100 to the busbar module or modules in a mounted position of the connection module 100. Alternatively or additionally, the connection module 100 comprises a latching profile 126 on a second longitudinal side LS2, opposite the first longitudinal side LS1, of the rear side 106 for effecting the positive-locking connection of the connection module 100 to the busbar module or modules in the mounted position.

The exemplary embodiment of the connection module 100 shown in FIG. 1 has a mounting recess 110, on the rear side 106, for receiving the busbar module in the mounted position.

The first longitudinal side LS1 and the second longitudinal side LS2 of the rear side 106 comprise surfaces turned towards one another—preferably in the mounting recess 110. The surface of the first longitudinal side LS1 has an opening from which the crossbar 114 projects in the mounted position. In the unlocked position, the crossbar 114 can be completely within the housing. The surface of the second longitudinal side LS2 has the latching profile 126.

A pivot lever 112 is mounted in a pivotably-movable manner in the housing. FIG. 1 shows an example of a pivot bearing 116 for supporting the pivotal movement of the pivot lever 112.

The pivot lever 112 is pivotably movable between the mounted position and an unlocked position. Upon the pivoting movement from the unlocked position to the mounted position, the pivot lever 112 moves the crossbar 114 out of the housing of the connection module 100 in order to effect the positive-locking connection to the busbar module.

The crossbar 114 can be connected to the pivot lever 112 in a rotationally-fixed manner via a lever arm—for example, as shown in the exemplary embodiment of FIG. 1. Alternatively, the crossbar 114 can be mounted so as to be longitudinally movable, wherein the pivotal movement of the pivot lever 112 is coupled to the longitudinal movement of the crossbar 114.

The connection module 100 further comprises a punch 124. The punch 124 can be completely within the housing in the locked position shown in FIG. 1. In the unlocked position, the punch 124 can project from the housing—preferably within the mounting recess 110.

The punch 124 can be connected to the pivot lever 112 in a rotationally-fixed manner via a lever arm—for example, as shown in the exemplary embodiment of FIG. 1. Alternatively, the punch 124 can be mounted so as to be longitudinally movable, wherein the pivotal movement of the pivot lever 112 is coupled to the longitudinal movement of the punch 124.

Upon the mounting of the connection module 100, the punch can bear against the busbar module and be pressed into the housing by the busbar module. Thereby, the punch 124 can move the pivot lever 112 from the unlocked position to the mounted position.

Optionally, the pivot lever 112 comprises a spring-elastic element 122. By means of the spring-elastic element 122, the crossbar 114 can be pre-tensioned in the mounted position, i.e., the crossbar 114 deviates from the mounted position only when a minimum force is determined by the pre-tension.

With each exemplary embodiment, a front side 102 of the housing can comprise at least two connection contacts 104 for connecting a consumer or source of a direct current. The connection module 100 further comprises at least two rail contacts, projecting on the rear side 106—preferably in the mounting recess 110—for branching off the direct current. The rail contacts are designed to each contact a busbar of the busbar module if the connection module 100 is in a position mounted on the busbar module.

In each exemplary embodiment, the connection module 100 can comprise a device circuit breaker, such as an electronic fuse for a direct voltage—preferably 24 V.

As described by example with reference to the exemplary embodiment of FIG. 1, exemplary embodiments of the busbar module 200 can form a distributor system—preferably in order to distribute a direct current of 24 V. In the distributor system, the busbars of adjoining busbar modules can be in electrical connection (for example, by means of punch contacts).

The busbar module or modules can be releasably attached to a support rail, e.g., a hat rail, by means of latching lugs.

The latching lugs can be formed on the first longitudinal side LS1 or second longitudinal side LS2.

Optionally, the busbar module is movable in the longitudinal direction LR (and opposite thereto) on the support rail. The longitudinal movement allows front sides of adjacent busbar modules 200 on the support rail to be brought into contact. A punch contact can electrically connect the front-side ends of corresponding busbars of the adjacent busbar modules to one another.

In order to be able to transfer a current strength of, for example, 40-A continuous current with a minimum installation space, a flat punch contact can be produced multiple times—preferably in triplicate—to form an assembly. As a result, the several contact points of a punch contact (for example, the three individual contact points of each laminated metal sheet of the punch contact) can divide the current amongst one another, such that overall heating is reduced.

Furthermore, such assembly of the punching contact is only small, such that this electrical connector of the busbars can be placed below a rail contact (that is, an electrical tap for contacting the individual busbars) of the mounted connection modules.

Figure 2:
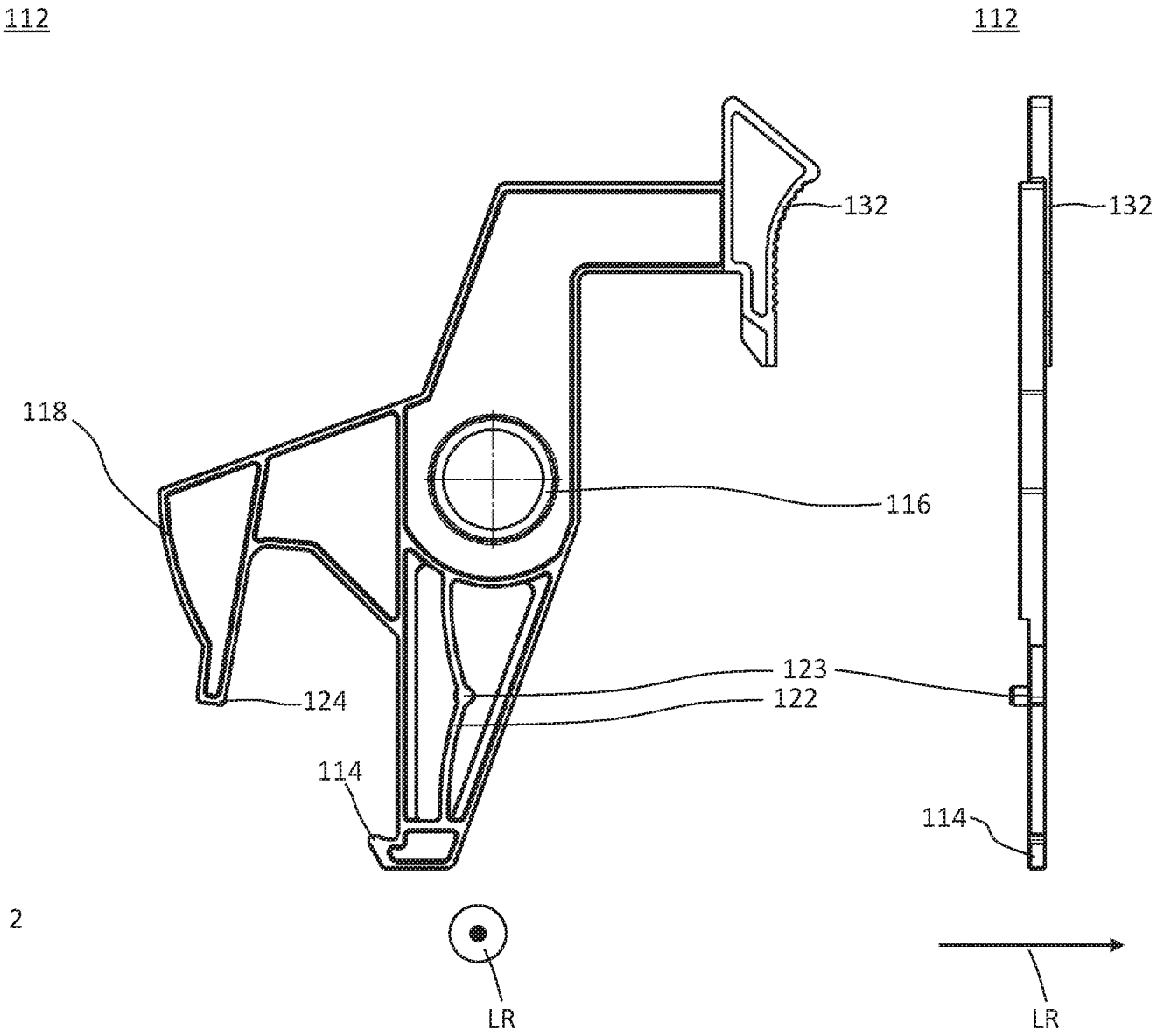
FIG. 2 shows a side view corresponding to the sectional view of FIG. 1, and an edge view of a pivot lever perpendicular thereto according to the exemplary embodiment.
Figure 3:
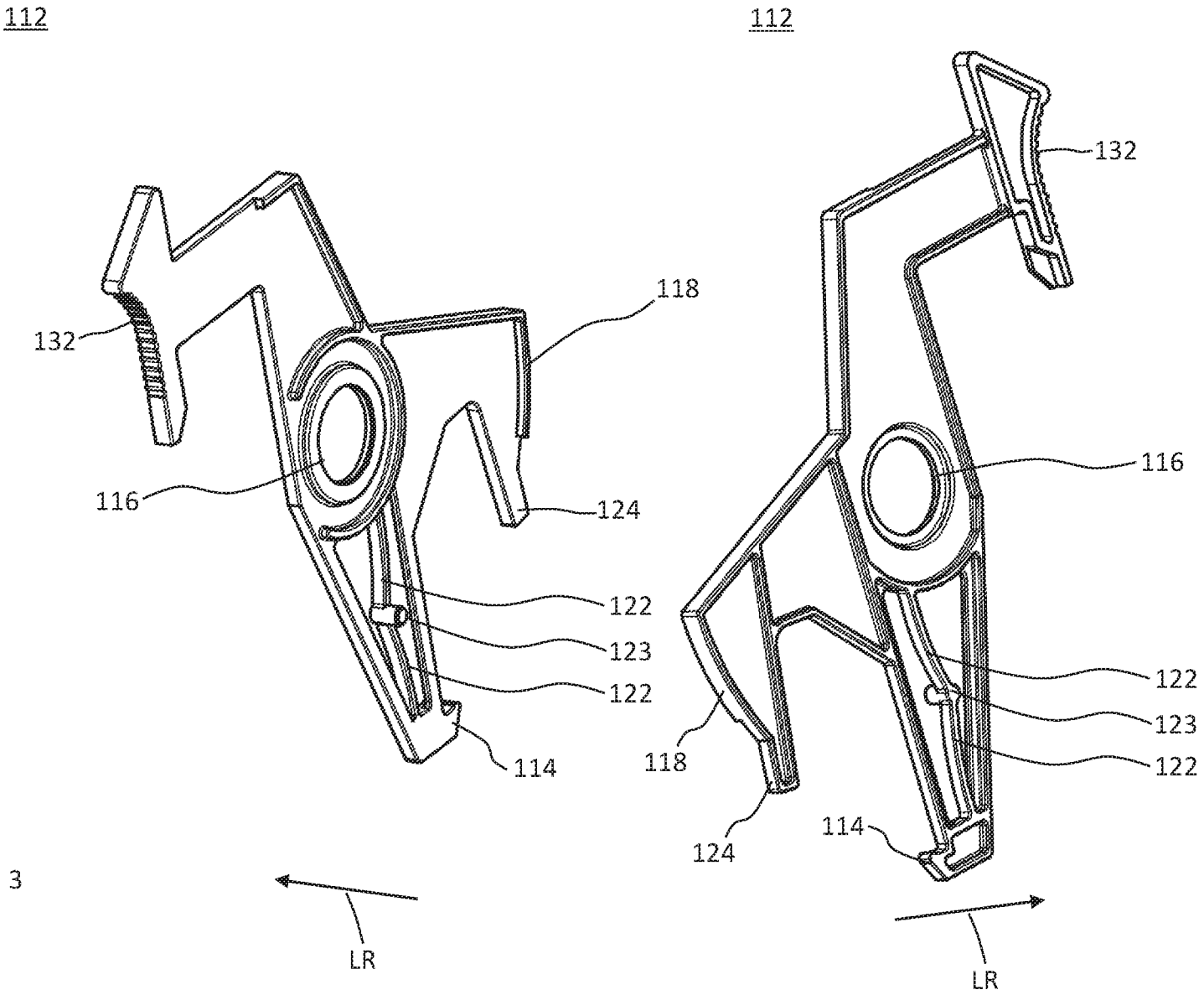
FIG. 3 shows two perspectival views of the pivot lever according to the exemplary embodiment of FIG. 2.

FIG. 2 shows on the left side a side view of the pivot lever 112 corresponding to the sectional view of FIG. 1. Furthermore, the right side of FIG. 2 shows and an edge view perpendicular thereto of the pivot lever 112 according to the exemplary embodiment of FIG. 1. FIG. 3 shows two perspectival views of the pivot lever 112 according to the exemplary embodiment of FIGS. 1 and 2.

The spring-elastic element 122 attached to the pivot lever 112 can comprise a section 123 movable with respect to the pivot lever 112. The movable section 123 can be mounted in a stationary manner in the housing of the connection module 100 upon the pivoting movement of the pivot lever 112—for example, bearing against an obstacle on one side in the housing of the connection module 100. As a result, the spring-elastic element 122 can exert a pre-tension, both in the mounted position and in the unlocked position, which secures the pivot lever in the mounted position or moves it from the unlocked position into the mounted position. A monostable mounting of the pivot lever can thus be realized.

In one variant, the spring-elastic element 122 comprises a sliding section 123 for bistable mounting of the pivot lever. Upon the pivoting movement of the pivot lever 112, the sliding section 123 can slide between the mounted position and the unlocked position via an obstacle arranged in a stationary manner in the housing of the connection module 100. For example, the spring-elastic element 122 can thereby exert a pre-tension, the pre-tension securing the respective position, on the pivot lever 112, both in the mounted position and in the unlocked position. Preferably, the pre-tensions of the mounted position and the unlocked position are opposite to one another.

In every variant of the mounting, the spring-elastic element 122 can comprise two curved spokes (for example, spring legs). The spokes can be connected to one another on the section 123 that is movable relative to the pivot lever (for example, in the case of monostable mounting) or on the sliding section 123 (for example, in the case of bistable mounting).

The section 123 can protrude from a plane of the pivot lever 112 (opposite the longitudinal direction LR or in the longitudinal direction LR), as shown on the left in FIG. 2. The section 123 can interact with an obstacle arranged outside the pivot plane of the pivot lever 112.

Figure 4:
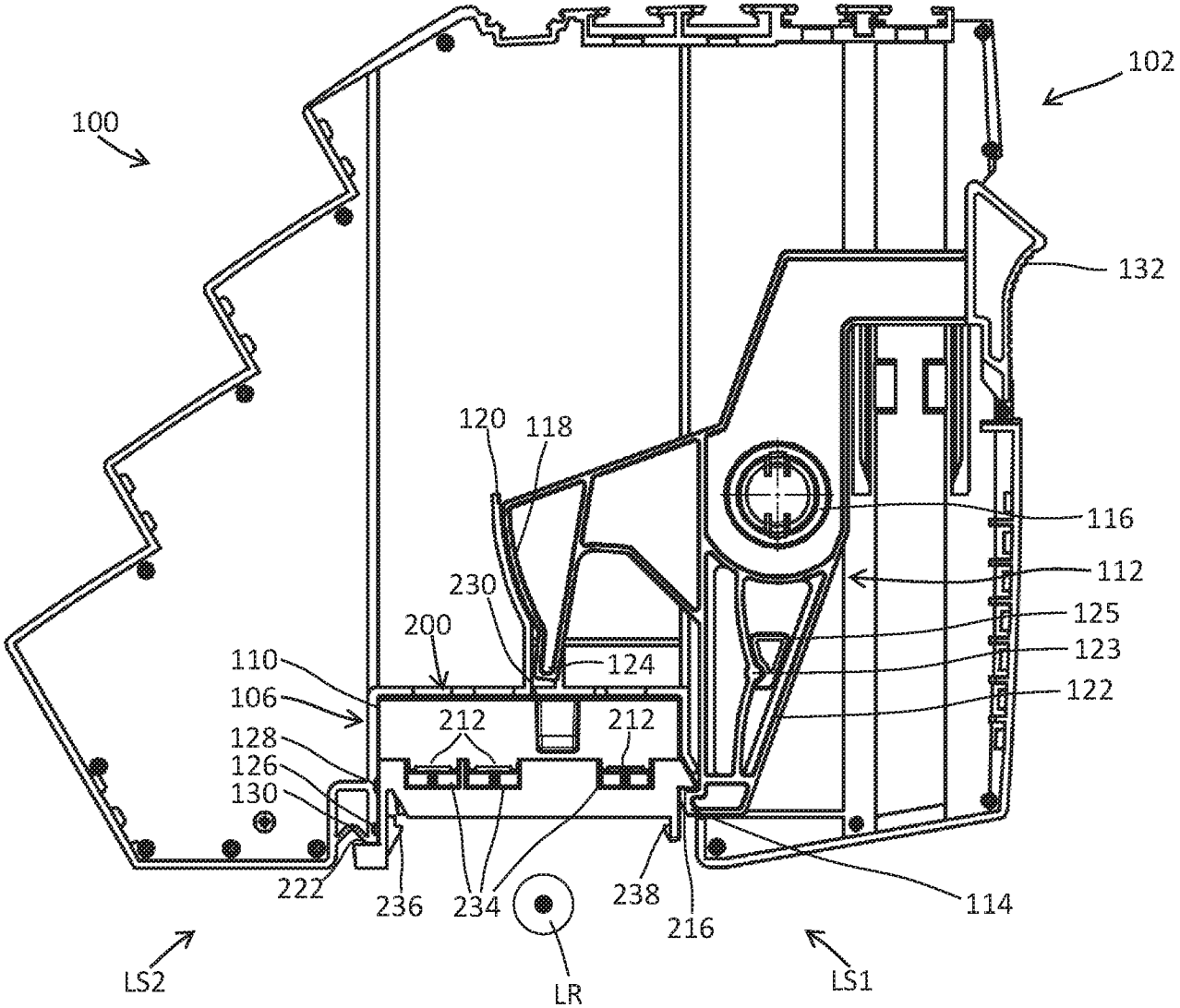
FIG. 4 shows a schematic sectional view of the exemplary embodiment of the connection module in a mounted position on an exemplary busbar module.

FIG. 4 shows a sectional view, corresponding to FIG. 1, of the exemplary embodiment of the connection module 100 mounted on an exemplary busbar module 200. That is, the exemplary embodiment of the connection module 100 (particularly, the pivot lever 112 of the connection module 100) is in the mounted position with respect to the exemplary busbar module 200.

The connection module 100 is preferably designed to branch off a direct current distributed in the longitudinal direction LR—for example, along a support rail. The support rail can be a conventional hat rail.

The exemplary busbar module 200 comprises a housing whose electrically-insulating rear section is connected or connectable in a positive-locking manner to the support rail.

For example, the busbar module 200 comprises latching lugs 236 and 238 turned towards one another on an underside of a rear section of the busbar module 200. If the busbar module 200 is pressed onto the support rail (for example, by pressure on the contact surface 230), the latching lugs 236 and 238 slide over, in the transverse direction, opposite latching bars, turned away from one another, of the support rail for the positive-locking connection of the rear section to the support rail.

A front section of the housing has a plurality of electrically-insulating transverse bars extending transversely to a longitudinal direction LR of the busbar module 200. Further, the busbar module 200 comprises at least two busbars 212, extending in the housing between the rear section and the front section in the longitudinal direction LR, which busbars are designed to be contacted by a gap between the transverse bars of the connection module 100 for branching off the direct current if the connection module 100 is in the position mounted on the busbar module 200. The orientation of the transverse bars is also referred to as the transverse direction.

The rear section of the housing of the busbar module comprises, on the first longitudinal side LS1, an indent 216 with a retaining surface that is preferably turned away from the front section and/or is turned towards the carrying rail. The retention surface is parallel to the longitudinal direction LR and the transverse direction.

As shown by way of example in FIG. 4, each exemplary embodiment of the connection module 100 can comprise the pivot lever 112, which is pivotably movable in the housing of the connection module 100. The pivot lever 112 is pivotably movable between the mounted position (shown by way of example in FIG. 4) and the unlocked position. The pivot lever 112 comprises a crossbar 114 that interacts with the indent 216 in the mounted position—preferably bearing against the retaining surface of the indent 216—to effect the positive-locking connection of the connection module 100 to the busbar module 200. In the unlocked position (shown by way of example in FIG. 5), the crossbar 114 releases the indent 216.

The pivot lever 112 can be mounted in a pivotably-movable manner on a slide bearing 116 in the housing of the connection module 100. Alternatively or additionally, the pivot lever 112, with a sliding surface 118 of the pivot lever 112, can be mounted in a pivotably-movable manner on a stationary sliding surface 120 in the housing of the connection module 100.

Preferably, the pivot lever 112 comprises a spring-elastic element 122 that exerts a pre-tension on the pivot lever 112. In a first variant, the pre-tension of the spring-elastic element 122 is able to pivot the pivot lever 112 from its unlocked position into the mounted position. For this purpose, the spring-elastic element 122 can comprise a section 123 movable with respect to the pivot lever 112 within a plane of the pivotal movement. The section 123, which is movable with respect to the pivot lever 112, bears, during the pivoting movement, against an obstacle 125 arranged in a stationary manner in the connection module 100. The deformation caused thereby (preferably, a change in the curvature) of the spokes of the spring-elastic element 122 results in a spring force that is capable of moving the pivot lever 112 from the unlocked position to the mounted position.

Figure 5:
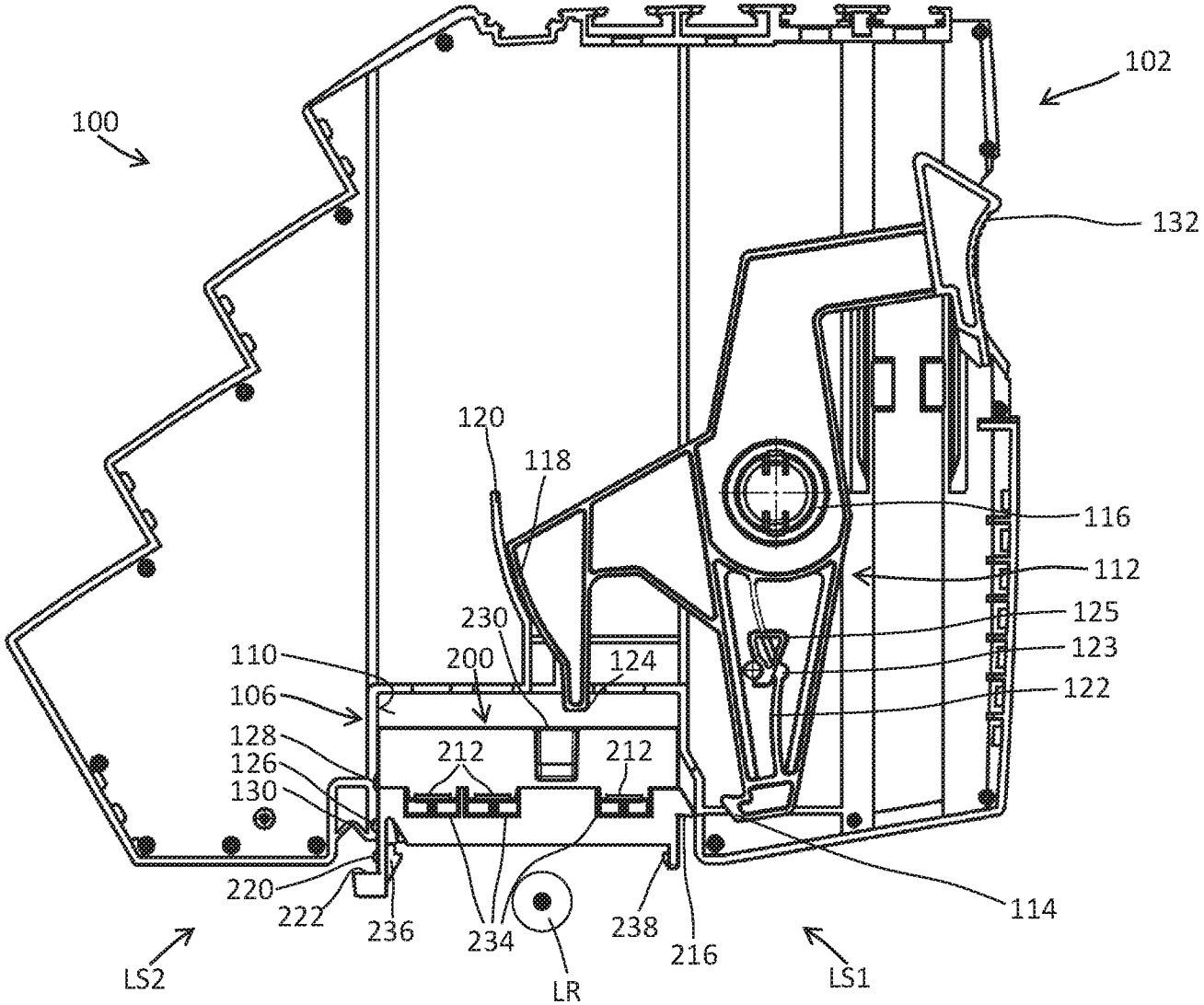
FIG. 5 shows a schematic sectional view of the exemplary embodiment of the connection module in an unlocked position on the exemplary busbar module.

In a second variant, schematically shown in FIGS. 4 and 5, the spring-elastic element 122 comprises a bistable sliding section 123. The bistable sliding section 123 bears against a first side of an obstacle 125 (for example, to the left of the obstacle 125 in FIG. 4) in the mounted position (shown by way of example in FIG. 4). In the unlocked position (shown by way of example in FIG. 5), the bistable sliding section 123 bears against a second side of the obstacle 125 opposite the first side (for example, to the right of the obstacle 125 in FIG. 5). By means of the bistable sliding section 123 sliding over the obstacle 125 between the first side and the second side, the pivot lever 112 can be bistable with respect to the unlocked position and the mounted position.

Optionally (for example, in the first and/or the second variants), as a result of the pre-tension in the mounted position of the pivot lever 112, upon the mounting of the connection module 100, a run-on slope of the crossbar 114 can slide over the run-on slope of the indent 216, and the crossbar 114 engage the indent 116 and be secured in the mounted position.

Preferably, the pivot lever 112 comprises a punch 114 arranged to apply a pressure to the contact surface 230 of the busbar module 200 upon the pivoting movement of the pivot lever 112 from the mounted position to the unlocked position, which pushes the busbar module 200 out of the mounting recess 110 of the connection module 100.

Alternatively or additionally (for example, if the pivot lever 112 is not yet in the mounted position), upon mounting, the punch 124 can be pressed from the contact surface 230 into the housing of the connection module 100, whereby the pivot lever 112, and thus the crossbar 114 connected to the pivot lever 112, is moved into the mounted position.

A latching profile 220, complementary to the latching profile 126 of the connection module 100, of the busbar module 200 is arranged on the second longitudinal side LS2 opposite the crossbar 114 in the transverse direction. For example, the latching profile 126 of the connection module 100 comprises a recess, and the complementary latching profile 220 of the busbar module 200 comprises a projection complementary in form to the recess, or vice versa.

Optionally, the rear side 106—preferably, the recess 110—comprises a spring-elastic mounting 128 of the latching profile 126. The spring-elastic mounting 128 can be realized by a weakening (for example, a local reduction in a wall thickness) of a wall on which the latching profile 126 is arranged. Alternatively or additionally, the latching profile 126 is supported on the rear side 106 via a spring-elastic element 130.

In the mounted position shown in FIG. 4, the latching profiles 126 and 220 on the second longitudinal side LS2 and the crossbar 114 and the indent 216 on the first longitudinal side LS1 are in each case engaged.

The pivot lever 112 comprises an operating surface 132 that is accessible at or adjacent to the front side 102 through an opening in the housing of the connection module 100. By pressing the operating surface 132, the pivot lever 112 can be moved to the unlocked position against the pre-tension of the spring-elastic element 122.

FIG. 5 shows a schematic sectional view of the exemplary embodiment of the connection module 100 in the unlocked position on the exemplary busbar module 200.

In the unlocked position shown in FIG. 5, the connection module 100 in the mounting recess 110 is moved away from the busbar module 100 in comparison to the mounted position shown in FIG. 4. The latching profiles 126 and 220 on the second longitudinal side LS2 along with the crossbar 114 and the indent 216 on the first longitudinal side LS1 are out of engagement in each case.

Optionally, the rear section of the housing on the second longitudinal side LS2 comprises a stop 222 that is deeper (that is, farther away from the connection module 100) than the latching profile 220.

For mounting a connection module 100, e.g., when transitioning from the unlocked position shown in FIG. 5 to the mounted position shown in FIG. 4, the connection module 100 can initially be brought into contact only with the stop 222 and then pushed over the indent 216 in a tilting movement with the longitudinal direction LR as the axis of rotation on the first longitudinal side LS1. Thereby, the crossbar 214 can slide on the connection module via the outwardly-inclined run-on slope of the indent 216 and/or, behind the indent 216, bear against the retaining surface in a positive-locking manner, wherein the latching profile 126 on the opposite, second longitudinal side LS2 engages in a positive-locking manner with a complementary latching profile 220 of the busbar module 200.

For example, when the connection module 100 is unlocked, the positive connection between the crossbar 114 and the indent 216 (for example, an undercut of the latch) can, via a rotational movement, be released first, and, subsequently, the pivot lever 112 can be pressed against the second longitudinal side LS2 (for example, an upper edge of the busbar module 200), in order to release the contacts and to distinguish the connection module 100 from an assembly of connection modules, so that it can be easily pulled out.

While in FIGS. 4 and 5, the busbars 212 of the exemplary busbar module 200 are turned with a flat side towards the connection module 100, in a variant of each exemplary embodiment, the busbar can be aligned with an edge to the connection module 100. In such a variant of the connection module 100, the rail contact of the connection module 100 can comprise a double-sided tulip contact. In order to achieve a sufficiently large contact surface for the current strength to be tapped, each rail contact preferably comprises a double-sided double contact, i.e., the busbar is in each case contacted twice on each side.

The connection module 200 can in each case comprise a partition wall extending in the longitudinal direction LR between adjacent busbars 212 of the connection module 200. Preferably, each busbar 212 is encased in a groove 234 extending in the longitudinal direction LR.

Each exemplary embodiment of the connection module 100 can comprise a device circuit breaker—preferably for 24-V DC and/or a limiting value of the current strength of 20 A to 40 A. In a distributor system with one or more busbar modules 200, the direct current can be distributed to several connection modules 100, e.g., without wiring expenditure in the case of branching off of the direct current from the busbars 212. The busbar module 200 or the electrically-connected busbar modules 200 can also be referred to as a "powerbus."

As described with reference to exemplary embodiments and variants, exemplary embodiments of the connection module (for example, of the device circuit breaker) can realize a hold on the busbar module or modules (for example, a distributor rail system) required for the secure contact of busbars. For this purpose, each connection module preferably comprises a pivot lever with a crossbar. For example, the pivot lever can comprise a spring-elastic element (for example, a spring leg or spokes), which applies a pre-tension and/or a restoring force (or a corresponding torque) to the pivot lever. The pre-tension and/or the restoring force can ensure the positive-locking connection (for example, the interlocking) of the connection module to the busbar module or modules.

The pivot lever can be monostable or bistable between an unlocked and a mounted position (and can therefore be referred to as a latch lever, for example).

Preferably, the pivot lever comprises a punch. Optionally, the punch can automatically move the pivot lever into the mounted position upon mounting (for example, when plugging in) the connection module, for a positive-locking by means of the latch.

For comfortable removal, an operating surface of the pivot lever can be actuated, whereby the pivot lever moves from the mounted position into the unlocked position. The punch of the pivot lever can apply a mechanical repulsion force to the housing of the distributor rail system, which leads to the separation of the electrical contacts. This means that the greatest force during removal has already been overcome, and the unlocked connection module (for example, the device circuit breaker) projects a few millimeters from the distributor rail system, which makes it easier for the user to grasp the connection module for removal.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

| List of reference signs | |
|---|---|
| Connection module | 100 |
| Front side of the housing of the connection module | 102 |
| Connection contact | 104 |
| Rear side of the housing of the connection module | 106 |

-continued

| List of reference signs | |
|---|---|
| Mounting recess | 110 |
| Pivot lever | 112 |
| Crossbar of the pivot lever | 114 |
| Pivot bearing of the pivot lever - preferably, radial slide bearing | 116 |
| Sliding surface of the pivot lever | 118 |
| Stationary sliding surface | 120 |
| Spring-elastic element of the pivot lever | 122 |
| Movable section or sliding section of the spring-elastic element | 123 |
| Punch of the pivot lever | 124 |
| Obstacle for bistable mounting | 125 |
| Latching profile of the connection module | 126 |
| Spring-elastic mounting of the complementary latching profile | 128 |
| Spring-elastic element of the complementary latching profile | 130 |
| Operating surface of the pivot lever | 132 |
| Longitudinal direction | LR |
| First longitudinal side | LS1 |
| Second longitudinal side | LS2 |
| Busbar module | 200 |
| Busbar | 212 |
| Indent | 216 |
| Complementary latching profile of busbar module | 220 |
| Stop | 222 |
| Contact surface | 230 |
| Partition wall | 232 |
| Groove | 234 |
| First latching lug | 236 |
| Second latching lug | 238 |

What is claimed is:

1. A connection module for mounting on a busbar module or several busbar modules extending in a longitudinal direction, comprising:

a housing, a rear side of which is mounted or mountable on the busbar module or busbar modules;

a crossbar, movable on a first longitudinal side of the rear side transversely to the longitudinal direction, so as to provide a positive-locking connection of the connection module to the busbar module or the busbar modules in a mounted position of the connection module; and a latching profile on a second longitudinal side, opposite the first longitudinal side, of the rear side, the latching profile being configured to provide a positive-locking connection of the connection module to the busbar module or the busbar modules in the mounted position.

2. The connection module according to claim 1, wherein the rear side comprises a mounting recess configured to receive the busbar module in the mounted position.

3. The connection module according to claim 1, wherein the first longitudinal side and the second longitudinal side of the rear side comprise surfaces turned towards one another, and wherein a surface of the first longitudinal side has an opening from which the crossbar projects in the mounted position and/or wherein a surface of the second longitudinal side has the latching profile.

4. The connection module according to claim 3, wherein the first longitudinal side and the second longitudinal side of the rear side of the housing comprise surfaces of the mounting recess turned towards one another.

5. The connection module according to claim 1, further comprising:

a pivot lever, mounted in the housing in a pivotably-movable manner, which is pivotably movable between the mounted position and an unlocked position, wherein, for providing the positive-locking connection to the busbar module, the pivot lever is configured to move the crossbar out of the housing of the connection module upon a pivoting movement from the unlocked position to the mounted position.

6. The connection module according to claim 5, wherein the pivot lever is configured to press a punch of the connection module against a contact surface of the busbar module upon the pivoting movement from the mounted position to the unlocked position.

7. The connection module according to claim 6, wherein the pivot lever is configured to press the punch of the connection module against the contact surface of the busbar module upon the pivoting movement from the mounted position to the unlocked position to release a contact between rail contacts of the connection module and the respective busbars of the busbar module or busbar modules.

8. The connection module according to claim 5, wherein the pivot lever is pivotably movable into the unlocked position by an operating surface projecting from the housing in the mounted position on a front side.

9. The connection module according to claim 8, wherein the pivot lever is pivotably movable from the unlocked position into the mounted position by a spring-elastic element.

10. The connection module according to 9, wherein the spring-elastic element is connected to the pivot lever and comprises a section that is movable relative to the pivot lever and bears against an obstacle arranged in the housing upon the pivoting movement between the unlocked position and the mounted position.

11. The connection module according to 10, wherein the spring-elastic element comprises two curved spokes that extend radially with respect to a pivot bearing of the pivot lever and are connected to one another at the movable section.

12. The connection module according to claim 10, wherein the pivot lever, the spring-elastic element, the punch, and/or the operating surface are integrally formed in one piece.

13. The connection module according to claim 5, wherein the pivot lever is mounted in a monostable manner with respect to the unlocked position and the mounted position, with the mounted position as the rest position, or wherein the pivot lever is mounted in a bistable manner with respect to the unlocked position and the mounted position.

14. The connection module according to claim 1, wherein the connection module is configured to branch off a direct current distributed along the busbar module or busbar modules.

15. The connection module according to claim 14, wherein the connection module is configured to branch off a direct current distributed along the busbar module or busbar modules, wherein the connection module further comprises:

at least two connection contacts configured to connect a consumer or a source of the direct current, and/or at least two rail contacts projecting on the rear side of the housing, which are configured to branch off the direct current in order to contact in each case one busbar of the busbar module if the connection module is in the position mounted on the busbar module.

16. The connection module according to claim 15, wherein when the connection module further comprises at least two connection contacts configured to connect a consumer or a source of the direct current, the connection contacts are arranged on a front side of the connection module.

17. The connection module according to claim 15, further comprising, in the housing between the rail contacts on the rear side and the connection contacts on the front side, an overcurrent protection device configured to protect the consumer or the source of the direct current.

18. The connection module according to claim 1, wherein the rear side is mounted or mountable on a first and a second busbar module adjoining each other in the longitudinal direction at their respective front sides.

19. The connection module according to claim 18, wherein the crossbar for the positive-locking connection of the connection module to the first and second busbar modules in the mounted position bears against both an indent of the first busbar module and an indent of the second busbar module, and/or wherein the latching profile for the positive-locking connection of the connection module to the first and the second busbar modules is engaged in the mounted position both with a complementary latching profile of the first busbar module and with a complementary latching profile of the second busbar module.

* * * * *